United States Patent [19]

Lovegrove

[11] 4,090,661

[45] May 23, 1978

[54] DEVICE

[75] Inventor: Brian Walter Lovegrove, Crawley, England

[73] Assignee: Fisons Limited, London, England

[21] Appl. No.: 708,090

[22] Filed: Jul. 23, 1976

[30] Foreign Application Priority Data

Aug. 8, 1975 United Kingdom ..... 33119/75

[51] Int. Cl.[2] ..... B04B 1/00

[52] U.S. Cl. ..... 233/1 R

[58] Field of Search ..... 233/1 R, DIG. 1, 11, 233/27, 28, 1 B, 1 A

[56] References Cited

U.S. PATENT DOCUMENTS

| | | | |
|---|---|---|---|
| 1,828,227 | 10/1931 | Juengst et al. | 233/1 B |
| 2,648,496 | 8/1953 | Cresswell | 233/DIG. 1 |
| 3,339,836 | 9/1967 | Mitchell et al. | 233/1 R |

*Primary Examiner*—George H. Krizmanich

*Attorney, Agent, or Firm*—Merriam, Marshall & Bicknell

[57] ABSTRACT

The present invention relates to a chamber for a centrifuge wherein the longitudinal circulation of air in the chamber is assisted. This is achieved, for example, by a specific form of lid for the chamber.

6 Claims, 1 Drawing Figure

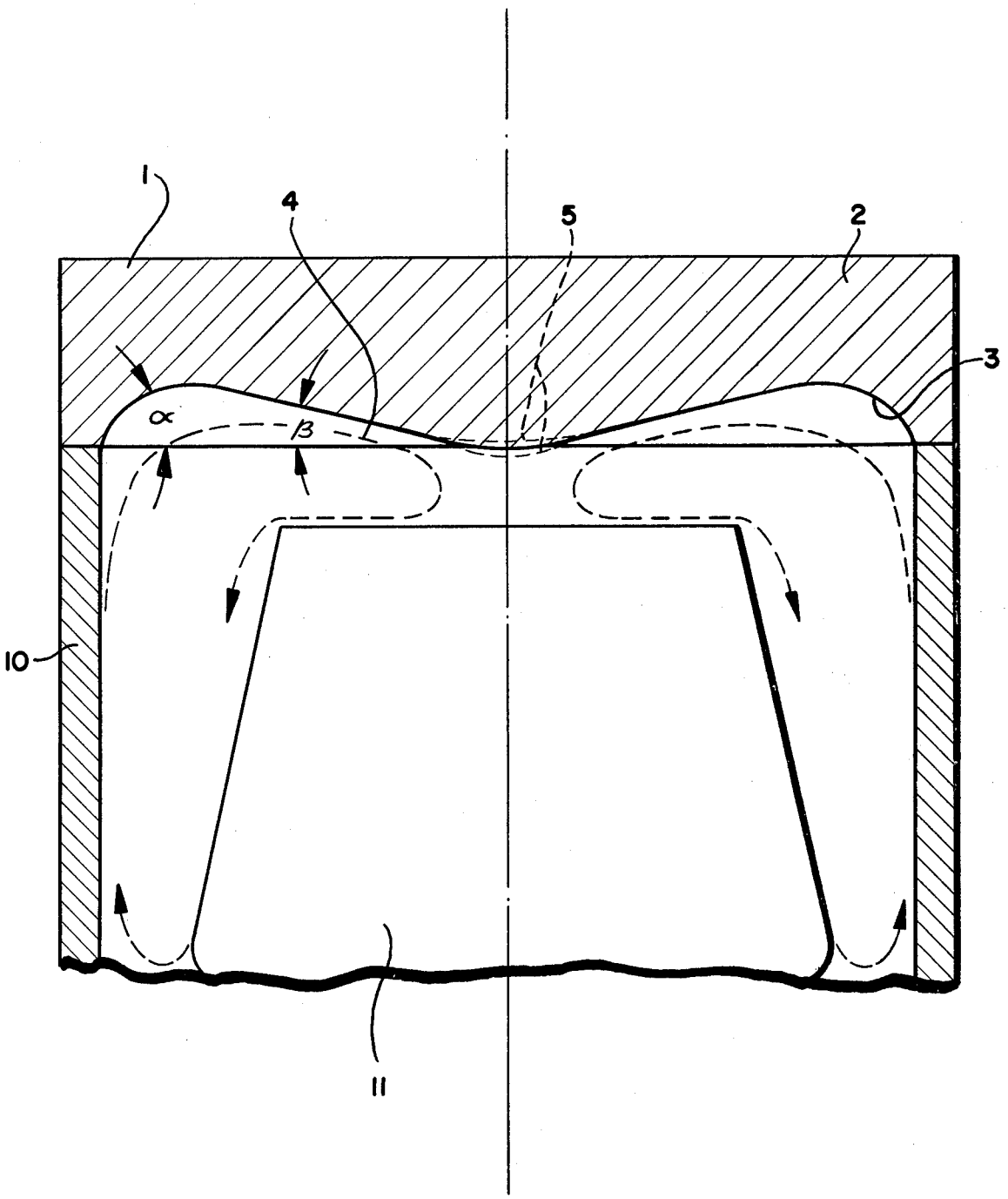
1
4
5
2
3
α
β
10
11

DEVICE

The present invention relates to a centrifuge lid.

In operating non-vacuum high speed centrifuges it is often desirable to cool the air in which the centrifuge bowl or rotor spins. However, in order to achieve satisfactory and uniform cooling it is necessary that the air around the bowl or rotor circulate. Hitherto, it has been considered necessary to ensure that the air circulates radially and it has been proposed to provide the lid of the chamber in which the rotor or bowl spins with sculptured vanes to assist circulation of the air. However, this has not proved wholly satisfactory. Surprisingly, we have now found it is necessary to ensure the longitudinal circulation of air within the chamber and that if the lid is formed with an annular dishing, the air circulation within the chamber is improved.

Thus, the invention provides a chamber within which a centrifuge rotor or bowl is to rotate characterised in that the arrangement of the chamber is adapted to assist longitudinal circulation of air within the chamber.

The invention further provides a lid for use with a chamber in which a centrifuge bowl or rotor is to rotate, which lid is provided with an internal generally annular depression, the depression having a rounded cross-section.

From another aspect, the invention also provides a centrifuge having a chamber in which the bowl or rotor of the centrifuge is to rotate, which chamber is provided with a lid of the invention.

The chamber of the invention will have a generally circular cross-section and is arranged so as to assist longitudinal circulation of air within the chamber whereby cooled air at the walls of the chamber is caused to flow up the chamber and into or over the bowl or rotor in the chamber, that is in a sence contrary to that which simple convection currents would generate. This may be achieved by diverging the side walls of the chamber towards the open end of the chamber whereby the swirling motion imparted to the air by the rotating bowl or rotor carries the air outwards and hence upwards. In addition it is also desired that the junction between the side walls and the base and lid of the chamber be rounded. However, we have found that the shape of the lid is the most important factor and that where a lid of the invention is employed, the chamber may be of the conventional cylindrical shape.

The lid may be of any suitable size and shape and may be made from any suitable material, e.g. metal or a synthetic polymer. The lid will usually be formed with an interior surface (having the depression) and an outer surface having a layer of thermal insulation, e.g. glass fibre mat or a foamed polymer, sandwiched between the two surfaces. Thus, the inner and outer surfaces may be formed as separate parts, e.g. as metal pressings or as moulded (notably vacuum formed) polymer sheets which are then fastened together by any suitable technique.

The depression is annular and preferably has the axis of the annulus located so that it will be substantially co-axial with the axis of rotation of the centrifuge bowl or rotor. The annulus has a rounded cross-section and thus may provide a toroidal depression or a cusped depression, i.e., the upstanding portion of the lid within the annulus may exist as a flat, rounded (convex) or sharp pointed area within the concaved area of the depression. The precise shape of the cross-section of the depression will depend inter alia upon the shape of the rotor or bowl and the shape of the chamber with which the lid is to be used. However, in general we prefer that the deepest portion of the depression lie over the rim of the bowl or rotor and that the depression does not have steeply inclined walls thereto. The function of the depression is to aid longitudinal circulation of the air within the chamber as shown dotted in the accompanying drawing.

To aid understanding of the invention a preferred form of lid will now be described by way of example only with respect to the accompanying drawing which is a vertical cross-section.

The lid comprises an outer panel 1, a layer of foamed polyurethane resin insulation 2 and an inner moulded panel 3. Panels 1 and 2 are made from a glass reinforced synthetic resin and are formed by a vacuum moulding technique.

Panel 3 has a generally central dished annulus 4. As shown in the drawing, the outer area of the annulus is dished at a comparatively shallow angle ($\alpha$) which typically has a value of from 10° to 15°. The annulus has a maximum depth of from 1 to 5 cms and the inner wall of the annulus is inclined less steeply than the outer wall ($\beta$is typically 5° to 10° ). The upstanding portion 5 of the lid within the annulus 4 is rounded and need not be level with the remainder of the lid, but could be recessed as shown dotted.

In use the lid is mounted upon a chamber 10 in which the centrifuge bowl 11 is to rotate. The lid may be hinged to a side wall of chamber 10 or be mounted upon slides so that it moves sideways to open and close chamber 10. When in position, the lid has the upstanding portion 5 located substantially centrally over the axis of rotation of bowl 11 as shown. The clearance between the rim of bowl 11 and the lid is typically 3 to 7 cms. The annulus 4 extends to substantially the side walls of chamber 10, so that the lid surfaces exposed to the interior of the chamber present rounded rather than angular edges and surfaces. Desirably, the walls of the chamber 10 are of rounded profile, e.g. are concaved, so as to provide a non angular interior with smooth transitions from one surface plane to another so as to assist circulation of air within the chamber.

I claim:

1. In a centrifuge having a walled chamber and a rotor mounted for rotation in said chamber, the improvement of means for increasing the longitudinal circulation of air between the chamber top and chamber bottom and longitudinally along the outer extent of said rotor and the chamber walls, said improvement comprising:

a lid mounted to the top of said chamber and having a face exposed to the interior of said chamber;

a generally annular depression within said lid face extending around the outer perimeter of said lid, the deepest portion of said lid face depression substantially overlying the outer extent of said rotor;

a projecting central portion of said lid face surrounded by said generally annular depression and located substantially centrally over the axis of rotation of said rotor;

said projecting central portion disposed adjacent the rim of said rotor;

an outer wall of said annular depression at the perimeter of said lid being aligned with said chamber wall;

an inner wall of said annular depression being contiguous with said projecting central portion;

said annular depression and said projecting central portion presenting continuous, smoothly merging surfaces within said chamber to assist the longitudinal circulation of air in said chamber; and said outer wall being inclined at a greater angle with respect to a transverse axis aligned with the top of said chamber than the incline angle between said inner wall and said transverse axis.

2. The improvement of claim 1, wherein said outer wall is inclined at an angle of 10° to 15° with respect to said transverse axis.

3. The improvement of claim 2, wherein said inner wall is inclined at an angle of from 5° to 10° with respect to said transverse axis.

4. The improvement of claim 1, wherein said annular depression is toroidal.

5. The improvement of claim 1, wherein said chamber walls diverge towards the chamber top.

6. The improvement of claim 1, wherein said chamber walls are concaved.

* * * * *